US006138867A

United States Patent [19]

Stelmack

[11] Patent Number: 6,138,867

[45] Date of Patent: Oct. 31, 2000

[54] TOWELETTE DISPENSER

[75] Inventor: Stanley K. Stelmack, Randolph, N.J.

[73] Assignee: Hercules Chemical Company Incorporated, Passaic, N.J.

[21] Appl. No.: 09/305,244

[22] Filed: May 4, 1999

[51] Int. Cl.[7] ..... B65H 1/00

[52] U.S. Cl. ..... 221/63; 206/812

[58] Field of Search ..... 221/33, 45, 61, 221/63, 307, 310; 206/812, 409

[56] References Cited

U.S. PATENT DOCUMENTS 1,814,650 7/1931 Waite .
3,143,256 8/1964 Lazure et al. .
3,249,266 5/1966 Coe et al. .
3,311,264 3/1967 Cayer .
3,893,593 7/1975 Hazard .
4,017,002 4/1977 Doyle et al. .
5,123,574 6/1992 Poulos .
5,704,471 1/1998 Yamada ..... 206/812
5,718,353 2/1998 Kanfer et al. ..... 221/63

*Primary Examiner*—Kenneth W. Noland
*Attorney, Agent, or Firm*—Stroock & Stroock & Lavan LLP

[57] ABSTRACT

A towelette container and a closure for the towelette container that includes a well that is sized and shaped to contain a portion of a towelette extending out of the container and that further includes a selectively movable cover having an opening defined therein that, when brought into alignment with the well, permits access to a towelettes.

29 Claims, 3 Drawing Sheets

TOWELETTE DISPENSER

BACKGROUND OF THE INVENTION

The present invention relates generally to dispensers and, more particularly, to a dispenser for separable pre-moistened material.

Pre-moistened towelettes, such as those used as disposable hand cleaners have myriad uses, including trade uses by mechanics and the like. When used in professional environments, the towelettes, and indeed, the dispensers, are advantageously durable. Whether used in a home environment or in a commercial environment, the dispensers should provide easy access to the towelettes and convenient closure, for example, to help prevent the towelettes within the dispenser from drying out.

A particularly well-known closure assembly for a towelette dispenser is disclosed in U.S. Pat. No. 5,718,353 (the '353 patent) to Kanfer et al., the contents of which are incorporated herein by reference. The closure assembly described therein includes a shallow cup-shaped closure at the top of a cover and a snap on cap, that provides a substantially air-tight seal of the dispenser. A key-hole shaped opening is provided in the closure to permit access to the towelettes within the dispenser and to make it convenient to remove one towelette at a time.

Conventional closures for towelette dispensers suffer from certain drawbacks. For example, many are not sufficiently durable for commercial use. Also, the end of the towelette extending out of the dispenser's closure frequently interferes with proper closure of the dispenser. Also, even if closure is achieved, a portion of the towelette extending out of the closure can act as a wick and dry out the fluid within the container, which is provided to keep the towelette moist.

Accordingly, it is desirable to provide an improved dispenser for articles such as pre-moistened towelettes and the like which overcomes inadequacies inherent in the prior art.

SUMMARY OF THE INVENTION

Generally speaking, in accordance with the invention, a dispenser and a closure (cover) for the dispenser are provided. The dispenser can store connected dispensable articles, such as pre-moistened towelettes or bulk fibers such as cotton and the like. The dispenser can include an inner chamber for storing the dispensable article, such as sheets that may be pulled out of the container one at a time. The closure can include a base having a well defined therein. The well is sized and shaped to accommodate at least a portion of the dispensable article. The well should also include an opening in communication with the inner chamber of the dispenser. Openings constructed in accordance with preferred embodiments of the invention are configured to hold a portion of the article being dispensed outside of the chamber and to facilitate, in preferred embodiments of the invention, removal of one towelette sheet at a time. In preferred embodiments of the invention, the opening of the well can include a thin membrane or film that can be easily broken to gain access to the contents of the chamber. For example, if the opening includes pointed flexible projections, the membrane can be formed between the projections. The closure can be in the form of a cover having a lid mounted to a base and the lid can have an opening defined therethrough. The lid can be selectively movable with respect to the base, between a first position in which the opening does not provide access to the well such that the cover seals the chamber and a second position which provides access to the well to permit removal of the article from the chamber.

Accordingly, it is an object of the invention to provide a dispenser which overcomes inadequacies of the prior art;

Another object of the invention is to provide a dispenser which provides advantages not realized by prior art constructions.

Yet Another object of the invention is to provide a container and closure therefor which is easier to use and more effectively seals the contents within the container.

Still other objects and advantages of the invention will in part be obvious and will in part be apparent from the specification and drawings.

The invention accordingly comprises an apparatus possessing the features, properties, and the relation of components which will be exemplified in the apparatus hereinafter described, and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENTS

The invention is directed to a container/dispenser and a closure for the container, such as containers constructed and arranged to store and dispense articles to be separated from a connected mass, such as pre-moistened cleaning materials, including pre-moistened towelettes. The dispenser includes a closure including a well that is sized and shaped to receive and store a portion of a towelette extending out of the opening. The closure can also include a selectively movable cover having an opening defined therein that, when brought into alignment with the well, permits access to the article to be dispensed which is extending through the opening. When brought out of alignment with the well, the closure can provide an effective air-tight seal, suitable to prevent articles such as pre-moistened towelettes within the container from drying out.

Figure 1:
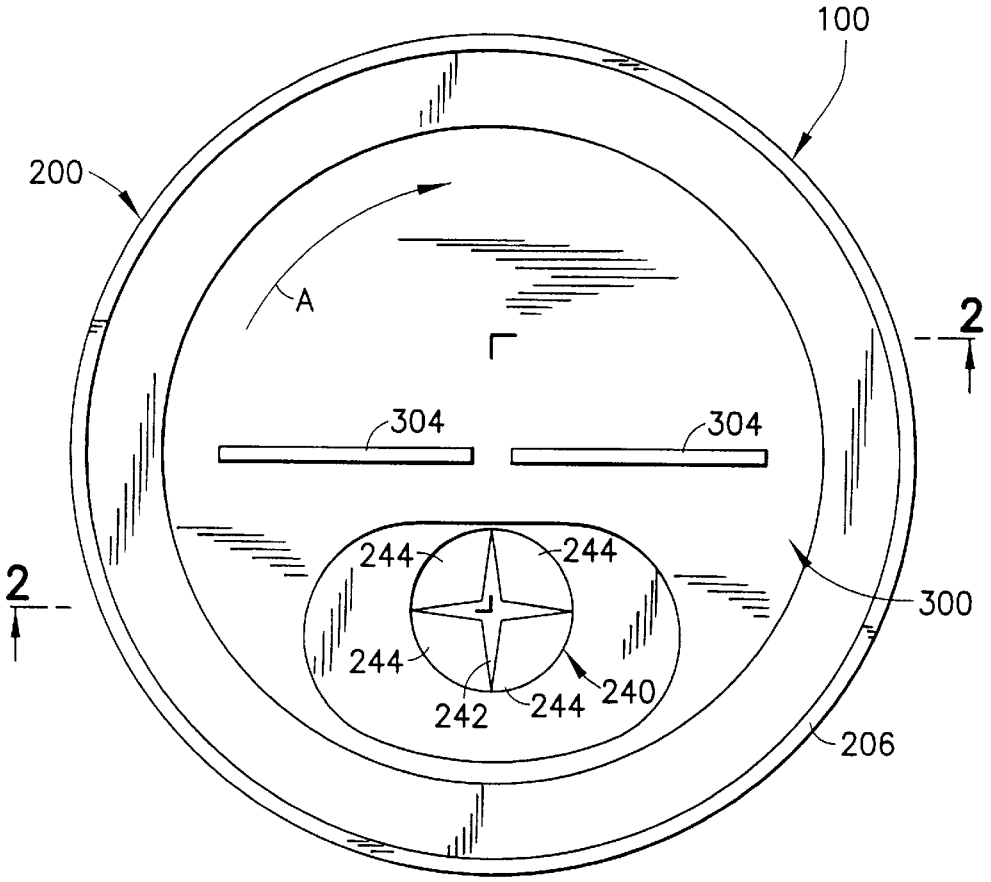
FIG. 1 is a top plan view of a dispenser cover, including a closure, constructed in accordance with an embodiment of the invention.
Figure 2:
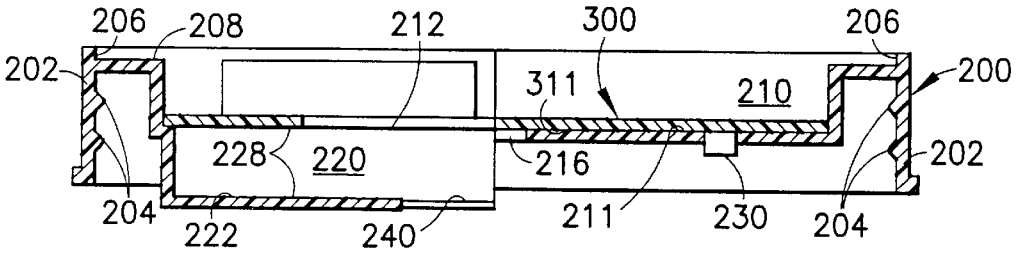
FIG. 2 is a side cross sectional view of the cover of FIG. 1, taken along section line 2—2.
Figure 5:
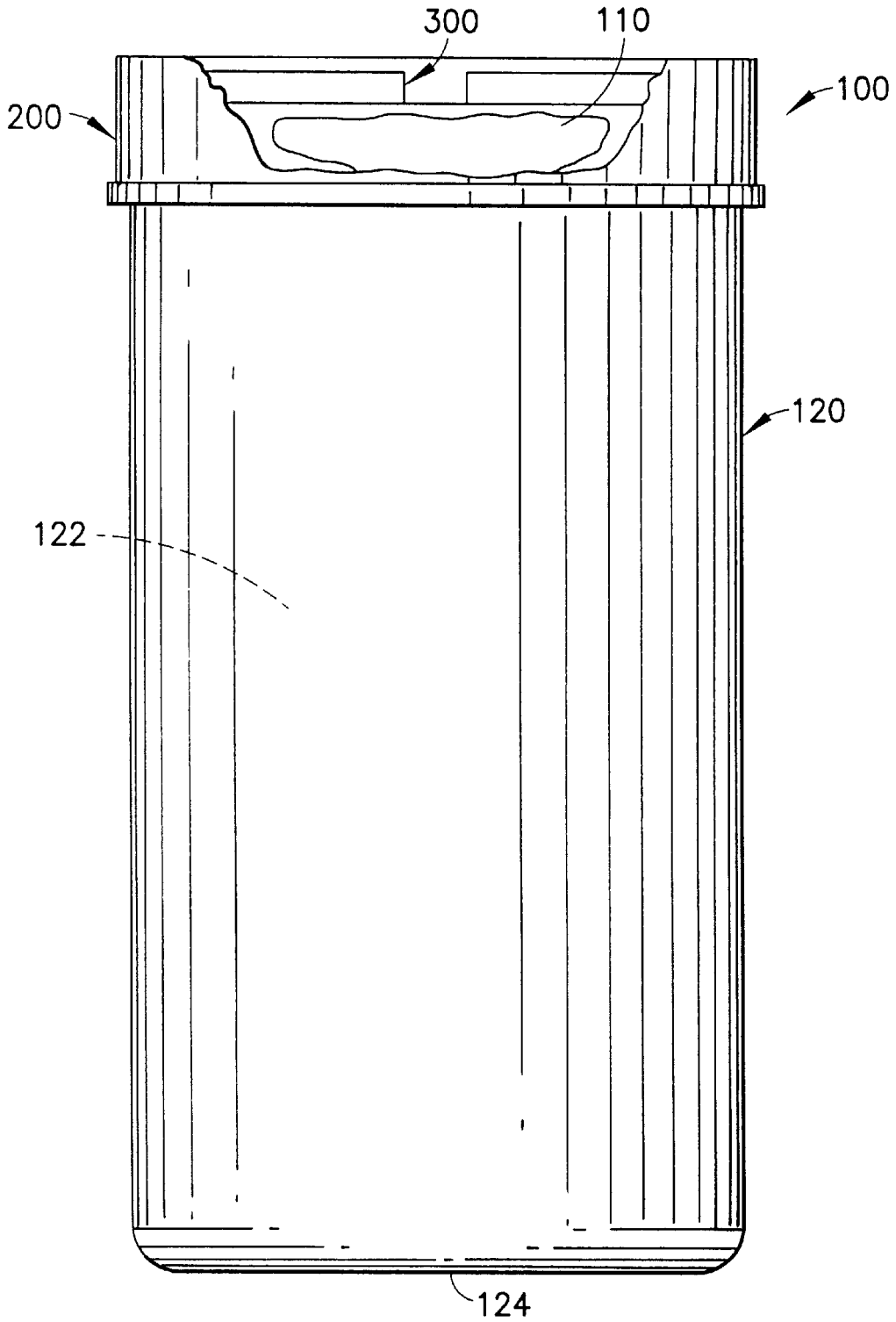
FIG. 5 is a side view of a towelette dispenser including a cover constructed in accordance with an embodiment of the invention.

Referring now to the drawings, an example of a container/dispenser and closure in accordance with a preferred embodiment of the invention is shown generally in FIGS. 1, 2 and 5, as a container 120 having a closure or cover 100 formed with a base 200 slidingly joined to a top 300, storing a separable connected dispensable article 110.

In a preferred embodiment of the invention, dispensable article 110 comprises a roll of connected rectangular towelettes, each attached to a preceding and following towelette at a perforated score or cut-line, to permit the towelettes to be easily separated from each other by pulling on a leading towelette, while restraining the next successive towelette in a manner well understood in the art. Threads 204, or other fastening means, such as a camming surface or snap fit rib are provided on an inside surface of a side wall 202 of base 200. Threads 204 engage a complementary structure on container 120 to secure closure 100 in place on container 120. It will be apparent to persons skilled in the art that numerous complementary fastening constructions may be provided on base 200 and container 120 to secure these pieces together, and that such fastening constructions may provide for selective removal of closure 100 from container 120. Alternatively, the fastening construction on base 100 and container 120 can secure these pieces together and prevent removal of closure 100 from container 120.

Figure 3:
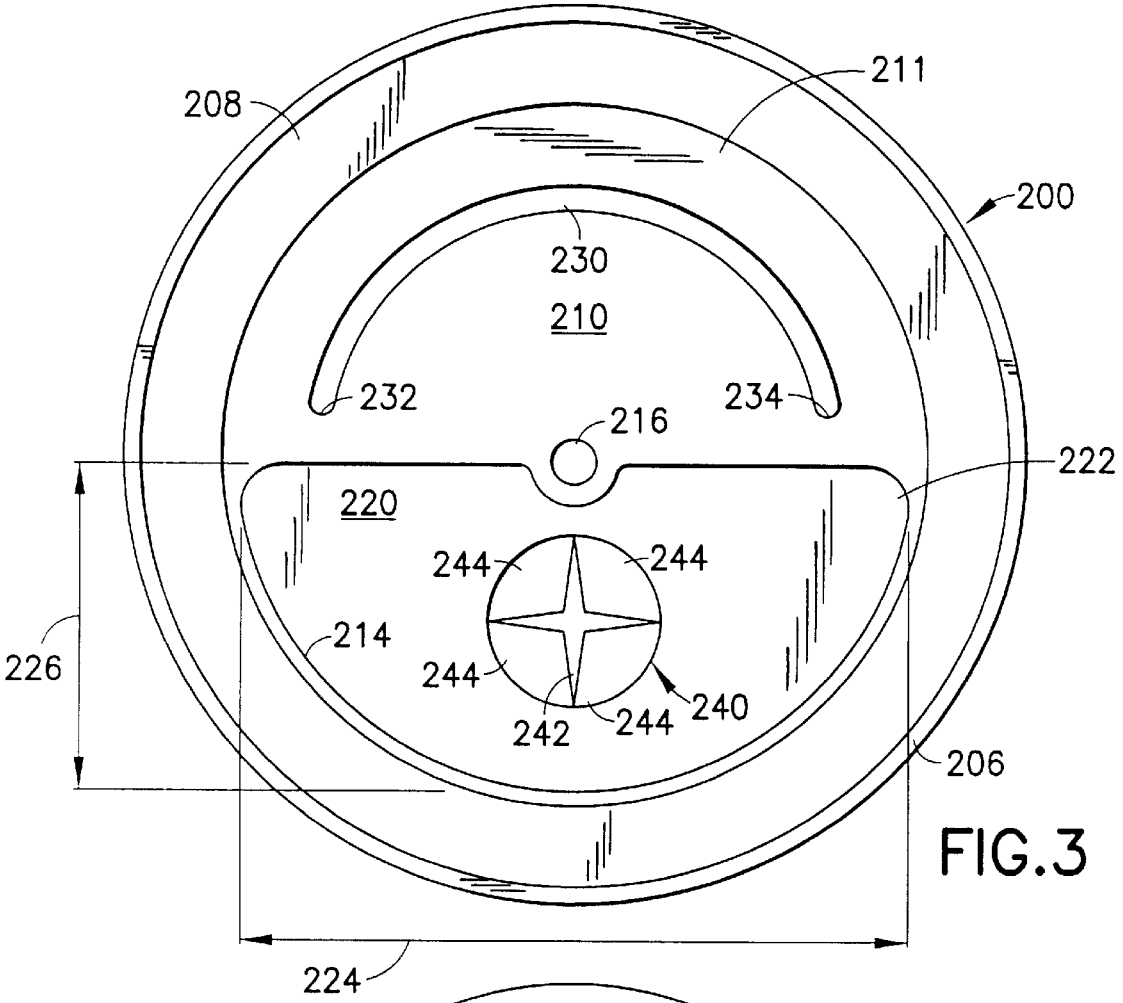
FIG. 3 is a top plan view of a base portion of the cover of FIG. 1.
Figure 4:
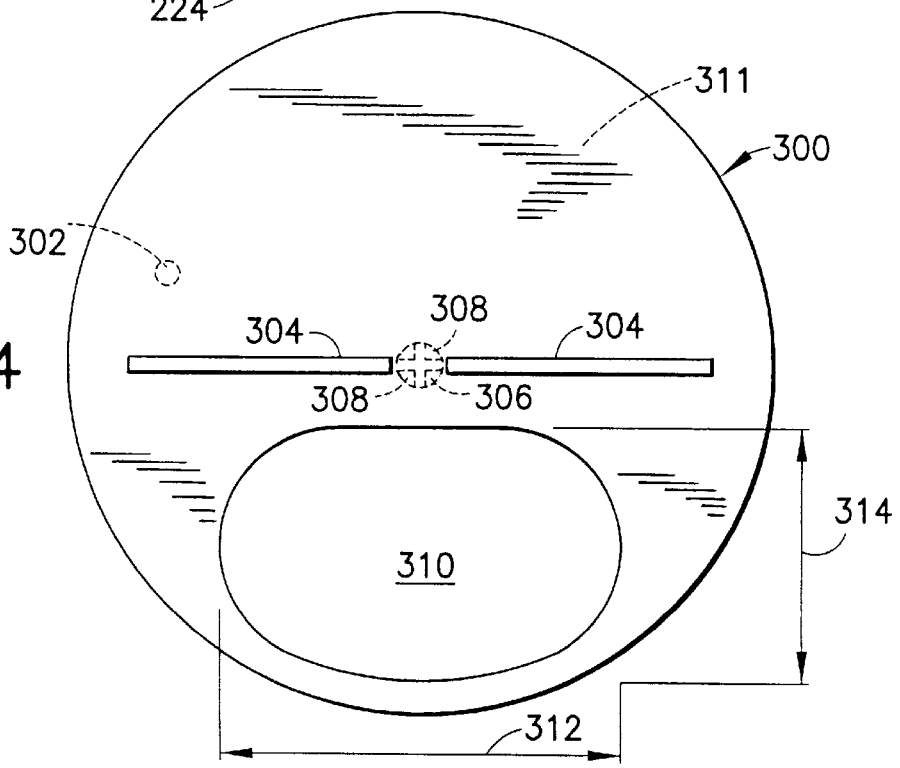
FIG. 4 is a top plan view of a top portion of the cover of FIG. 1.

With additional reference to FIGS. 3 and 4, base 200 includes a first well 210 defined therein having a top surface 211. Top 300 includes a bottom surface 311 which meets and is in sliding engagement with top surface 211 of well 210. Thus, top 300 rests on base 200 and is selectively rotatable, in both a clockwise and a counterclockwise direction, within first well 210. A second well 220 is defined in the bottom of first well 210, extending downwards into an inner chamber 122 of container 120 and includes a star-shaped aperture 240 defined through a bottom surface 222 of second well 220.

Aperture 240 provides access to inner chamber 122 of container 120. A plurality of resilient pointed members 244 are provided in aperture 240 that frictionally engage a towelette 110 (or other dispensable article) as the article is pulled-out of container 120, i.e. as the article is dispensed. The resilient members 244 also facilitate tearing a leading towelette 110 from a following towelette as it is removed from container 120. In general, aperture 240 is sized so that the friction imparted to a sheet is not sufficient to tear the sheet itself. Therefore, after one sheet is pulled completely through aperture 240, a second sheet begins to be pulled through. If advantageously constructed, resilient members 244 will catch in the perforated cut-line and initiate separation of towelettes. As more and more of the second sheet is pulled through aperture 240, the forces acting on the second sheet should cause the first sheet to separate from the second sheet at the perforations, leaving a small portion of the second sheet extending through aperture 240. The volume of second well 220 should be adequate to receive this small portion.

A membrane 242 can be advantageously initially provided between resilient members 244 to seal inner chamber 122 and to prevent the towelettes from drying out before the dispenser is put into use. Alternatively, a moisture proof barrier, such as a plastic or foil film can be disposed over aperture 240. Membrane 242 is preferably thick enough to avoid unintentional or accidental breakage and access to the container cavity, yet thin enough to permit easy and quick intentional access, e.g., breakage occurring with sufficient intentional pressure. In a preferred embodiment, the membrane is about 0.001 to 0.003 inches, more preferably approximately 0.002 inches thick.

An opening 310 is defined through top 300. Opening 310 can be selectively positioned by rotating top 300 with respect to base 200 with respect to base 200 to align with and provide access to second well 220 and to the portion of towelette 110 extending through opening 240 and contained in well 220. The position of opening 310 with respect to second well 220 is controlled by rotating top 300 within first well 210, by advantageously using a pair of wing tabs 304, or other suitable movement structures.

In FIG. 1, opening 310 is depicted in a position of alignment which provides maximum access to second well 220 and to towelette 110 (or portion thereof) provided therein. In this position, an end of towelette 110 is freely accessible to a user and easily dispensable from container 120. Top 300 is selectively movable from the position depicted in FIG. 1 to a position in which the top 300 establishes a substantially air-tight seal of second well 220, i.e. a closed position. The air-tight seal can be achieved by interference between top 300 and base 200. Additional sealing structures such as gaskets can be provided. Movement of top 300 from the position depicted in FIG. 1 to the closed position is preferably accomplished by moving the top 300 in a generally counter-clockwise direction, as depicted by an arrow A in FIG. 1. While this is the preferred movement direction, the present invention also contemplates movement of the top 300 in a clockwise direction. Alternatively, the relative positions of opening 310 and second well 220 can be changed by constructing top 300 and base 200 to be in a linear sliding arrangement such that top 300 is retracted from a position over second well 220.

Top 300 is secured to base 200 by fasteners that will permit rotation of top 300 with respect to base 200. In a preferred embodiment, a hole 216 defined through a top surface 211 of first well 210 is sized and shaped to accept a spilt pin 306 that includes a plurality of flexible tabs 308 that compress as pin 306 is forced through opening 216. Tabs 308 reflex once pin 306 has been pushed through opening 216 a predetermined distance and provide a lock to secure top 300 to base 200 and to permit the selective rotation of top 300 with respect to base 200.

The diameter and general dimensions of first well 210 are approximately the same as the outer diameter of top 300. However, since movement of top 300 within first well 210 is provided, some minimal tolerance is necessary between these two diameters.

A stop pin 302 (see, e.g., FIG. 4) is advantageously provided on top 300 to limit the rotational movement thereof. Stop pin 302 is sized and shaped to ride within a channel 230 defined in top surface 211 of first well 210. As depicted in FIG. 3, channel 230 defines a substantially semi-circular path over which stop pin 302 may travel as top 300 is selectively aligned with respect to base 200. Movement of top 300 is limited by the ends 232, 234 of channel 230. When stop pin 302 engages a first end 232 of channel 230, opening 310 provides maximum access to second well 220 and to towelette 110 located therein. When stop pin 302 engages a second end 234 of channel 230, top 300 provides a substantially air-tight seal of second well 220. Top 300 is freely movable between the above-described opened and closed positions, and may also be positioned to provide partial access to second well 220.

The portion of towelette 110 that remains exposed, i.e., located out of inner chamber 122 through aperture 240, will tend to wick moisture and other liquids away from the towelettes 110 located within cavity 122. Over time, this will tend to dry out towelettes 110, rendering them less effective. It is thus desirable to control access to second well 220 to prevent drying out of the portion of towelette 110 contained therein and to prevent wicking of towelettes 110 within container 120. At the same time, easy access to towelette 110, i.e. to second well 220 through the opening 310, is also desirable. Thus, opening 310 is preferably sized to permit a user to grasp a portion of towelette 110 in the second well 220 with the user's thumb and forefinger. Thus, sizes and shapes which permit access with the thumb and forefinger of even large handed individuals are advantageous. Opening 310 has a width 312 that is advantageously approximately 1.5 to 3.0 inches and a length 314 that is advantageously approximately 1.0 to 2.0 inches. In a preferred embodiment, the width is approximately 2.2 inches and the length is approximately 1.4 inches. The area of opening 310 is advantageously from 1.5 to 3.75 inches.

Second well 220 defines a volume that provides optimal storage of and access to the portion of a towelette 110 extending through and retained by opening 310. The actual dimensions that define the second well 220 can depend, at least in part, on the size of container 120 in connection with which closure 100 of the present invention is used. It is desirable to size second well 220 to accommodate enough of a towelette 110 to facilitate easy grasping and removal by a user. It can also be sized to accommodate a large portion or even the entire volume of a sheet of towelette 110, to provide easy effective closure by preventing any portion of towelette 110 from interfering with closure of cover 100. Second well 220 advantageously has a width-wise dimension 224 that is between approximately 1.5 and 4.0 inches, a length-wise dimension 226 that is between approximately 1.5 and 2.0 inches, and a depth 228 (see, e.g., FIG. 2) that is not less than approximately 0.3, preferably 0.5 inches. In a preferred embodiment, the width-wise dimension 224 is approximately 3.5 inches and the depth is about 0.5 inches. The volume of second well 220 is about 1 to about 4 cubic inches, preferably about 1.2 to about 3.6 cubic inches.

As can be seen in FIGS. 2 and 3, in a preferred embodiment of the invention, no parts of closure 100 extend above a plane defined by a lip 206 peripherally disposed about top 200. Together with a top surface 208, lip 206 defines a receptacle that may accept and secure a container 120 when a bottom 124 (see, e.g., FIG. 5) of container 120 is placed in stacking relation with top 200. Thus, a plurality of containers 120, each equipped with closure 100 and constructed in accordance with the present invention, may be securely stacked for shipment, storage, and the like.

In operation, membrane 242 initially prevents access to and evaporation of liquids from container cavity 122 and towelettes 110 contained therein. A user can rupture membrane 242 with a finger or pointed object, and a first towelette 110 (the towelettes are typically provided on a roll within the container 120) may be drawn through opening 240. As one towelette 110 is drawn through opening 240, the resilient members 244 frictionally engage the next towelette 110 and facilitate tearing of such towelette 110 from a prior towelette. After a towelette 110 has been removed by a user, a portion of a successive towelette 110 remains extending out of chamber 122 and through opening 240. This portion can be tucked into second well 220 and top 300 can be rotated to provide a substantially air-tight seal of second well 220. Another towelette 110 can be removed from container 120 by rotating the top 300 so that the opening 310 is aligned over second well 220 (i.e., until the stop pin 302 engages the first end 232 of the channel 230), thus providing access to the portion of towelette 110 contained in second well 220.

A dispenser in accordance with the invention can advantageously be formed of various well known thermoplastics and resins, such as polypropylene with a gloss exterior finish. The material within the dispenser can be in the form of connected mass of floss fibers, such as cotton or synthetic fibers. Advantageously, the dispensed material is a roll of rectangular non-woven fabric sheets soaked in any of several well known cleaning fluids. One well from fluid/towel combination contains water, dibasic ester mixture, d-Limonene, nonoxynol 10, modified coconut diethanolamine, sodium alkane sulfate, dimethicone, lanolin, propylene glycol, aloe extract and vitamin E and is sold by Hercules Chemical Co., Inc., Passaic, N.J. 07055 under the trademark HERCULES FOR HANDS.

A dispenser in accordance with the invention can include a storage container and a cover. The cover can include a top surface and a well. The well can include an aperture for dispensing articles, such as towelettes and can be provided as a plurality of pointed projections separated by a breakable membrane to seal the container prior to initial use. The well can be selectively opened and closed by providing the cover with a sliding portion having an opening which can be rotatable with respect to a base portion of the cover. The well can be of equal or greater volume than an entire sheet. It can be at least as large as one half the volume of a sheet or smaller, as long as enough volume is provided to receive all of the portions of the dispensed article extending out of the aperture when the cover is closed. The dimensions of the opening and well should be large enough to receive the thumb and forefinger of an adult hand. When the opening and well are aligned, sheets can be dispensed. When out of alignment, the container can be thereby sealed.

It will thus be seen that the objects set forth above, among those made apparent from the preceding description, are efficiently attained and, since certain changes may be made in the above composition of matter without departing from the spirit and scope of the invention, it is intended that all matter contained in the above description shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A container storing dispensable separable material, comprising:

a storage chamber storing a majority of a dispensable connected separable material and a fluid absorbed into the material;

a selectively openable cover joined to a top end of the storage chamber, the cover selectively disposable between an open position in which the material in the storage chamber is accessible and a closed position in which the storage chamber is substantially sealed by the cover and the material within the chamber is not accessible;

the cover including a base and a top slidingly joined to the base;

the base including a top surface in sliding engagement with a bottom surface of the top and a well defined by walls of the base depending from the top surface of the base towards the chamber;

the well having a gripping aperture formed therein, the gripping aperture formed to slidingly grip the material as it is withdrawn from the storage chamber through the gripping aperture and provide sufficient gripping resistance to hold the material in place as the material extends through the gripping aperture and out of the chamber with a portion of the material extending from the chamber into the well; and the top having an opening formed therein, and being slidingly disposable between a first open position in which the opening aligns at least partially with the well to permit access to the well and a second closed position in which the opening is not aligned with the well and the top substantially seals the material within the chamber.

2. The container of claim 1, wherein the dispensable material is in the form of a plurality of sheets joined at separable score lines.

3. The container of claim 1, wherein the top is rotatable with respect to the base of the cover, between the open and closed positions.

4. The container of claim 1, wherein the opening in the top has an area of about 1.5 to about 3.75 square inches.

5. The container of claim 1, wherein the opening in the top has a first dimension of about 1.5 to 3.0 inches and a second dimension of about 1.0 to 2.0 inches.

6. The container of claim 1, wherein the well is at least about 0.3 inches deep and has a second dimension of about 1.5 to 4.0 inches and a third dimension of about 1.5 to 2.0 inches.

7. The container of claim 1, wherein the well is at least 0.5 inches deep.

8. The container of claim 1, wherein the well has a volume of about 1 to about 4 cubic inches.

9. The container of claim 2, wherein the volume of the well is not less than about the volume of one of the sheets.

10. The container of claim 2, wherein the volume of the well is not less than one half the volume of one of the sheets.

11. The container of claim 1, wherein the gripping aperture includes a plurality of pointed pliable projections.

12. The container of claim 11, wherein the aperture includes a thin breakable membrane between the projections which seals the chamber when the top is in the open position, the aperture constructed so that access to the chamber is achieved by breaking the membrane.

13. The container of claim 1, wherein the opening comprises between about 0.2 and 0.5 the area of the top.

14. The container of claim 1, wherein the top includes a pair of projections extending upwards from the upper surface thereof.

15. The container of claim 2, comprising cleaning fluid absorbed by the sheets.

16. The container of claim 15, wherein the sheets comprise rectangles formed of non-woven fabric.

17. A container storing sheet-like dispensable articles capable of being dispensed from the container as sheets, comprising:

a storage chamber storing sheet-like material having cleaning fluid absorbed therein;

a closure having a base and a top in sliding engagement with the base selectively sealing the chamber and providing access to the material;

the base having a well defined therein, said well being sized and shaped to accommodate a portion of the sheet-like materials, said well including an opening through which the material can extend;

the top having defined therethrough an opening, said top being selectively movable between a first position in which said opening does not provide access to said well, and a second position which provides access to the well.

18. The closure of claim 17, wherein said closure comprises means for arresting movement of said lid as said lid is selectively moved between said first and said second positions.

19. The container of claim 18, wherein said well has a bottom surface and wherein said movement arresting means comprises:

a channel defined in a top surface of said base; and a stop pin provided on said top that rides within said channel as said top is selectively moved between said first and said second positions.

20. The container of claim 1, wherein said top comprises a wing tab for selectively moving said top between said first and said second positions.

21. The top container of claim 17, wherein said well is defined by a first dimension that is between approximately 1.5 and 4.0 inches, a second dimension that is between approximately 1.5 and 1.8 inches, and a third dimension that is not less than approximately 0.5 inches.

22. The container of claim 21, wherein said well first dimension is approximately 3.5 inches.

23. The container of claim 17, wherein said opening defined through said top is defined by a first dimension that is approximately 1.5 to 2.5 inches, and a second dimension that is approximately 1.0 to 1.5 inches.

24. The container of claim 23, wherein said opening first dimension is approximately 2.2 inches and wherein said opening dimension is approximately 1.5 inches.

25. The container of claim 17, wherein said lid provides a substantially air-tight seal to said well when said top lid is in said first position.

26. The container of claim 17, wherein said means for communicating with the inner cavity of the container comprises an aperture having a plurality of resilient members that collectively frictionally engage the sheets as they are pulled out of the container.

27. The container of claim 26, wherein said means for communicating comprises a membrane having a predetermined thickness disposed between said plurality of resilient members, said membrane initially preventing access from said well to the storage chamber of the container and to the sheets therein.

28. The closure as recited by claim 27, wherein said membrane is approximately 0.001 to 0.003 inches thick.

29. A container for a dispensable article, comprising:

a container defining an inner cavity for holding the dispensable article;

a closure for said container comprising a base having a first well defined therein by a raised annular wall , said first well having a second well defined therein and depending downwards from a top surface of the first well and being sized and shaped to accommodate a part of the dispensable article, said second well including means for communicating with the inner cavity of the container; and a lid mounted to said base and having defined therethrough an opening, said lid being selectively movable between a first position in which said opening does not provide access to said second well, and a second position which is out of said first position.

* * * * *